US005485689A

United States Patent [19]

Jonninen

[11] Patent Number: 5,485,689

[45] Date of Patent: Jan. 23, 1996

[54] BUCKET CRUSHER

[75] Inventor: Markku Jonninen, Hollola, Finland

[73] Assignee: Ideachip Oy, Hollola, Finland

[21] Appl. No.: 261,410

[22] Filed: Jun. 17, 1994

[30] Foreign Application Priority Data

Jun. 17, 1993 [FI] Finland ..... 932791

[51] Int. Cl.[6] ..... E02F 3/92

[52] U.S. Cl. ..... 37/189; 37/303; 37/406

[58] Field of Search ..... 37/189, 403, 406, 37/901, 903, 303; 241/143, 222; 171/24, 133; 299/63, 67

[56] References Cited

U.S. PATENT DOCUMENTS 3,959,897 6/1976 May ..... 37/303

4,005,755 2/1977 Bakke et al. ..... 37/303 X 4,030,626 6/1977 Durham ..... 37/406 X 4,113,023 9/1978 Baskett ..... 37/403 X

*Primary Examiner*—Terry Lee Melius

*Assistant Examiner*—Robert Pezzuto

*Attorney, Agent, or Firm*—Gary A. Hecht; John W. Logan, Jr.

[57] ABSTRACT

The invention relates to a bucket crusher to be mounted in place of the bucket of an excavator or a bucket loader. Horizontal crushing shafts (12) provided with crushing tools are superimposed at a small distance from each other and adapted to be rotated in the same rotating direction. A pivoting axle (4) for a pivotably journalled compression and feeding plate (1) is located in the top section of the bucket. The plate (1) can be turned for pressing the material to be crushed against the crushing shafts, whose rotating direction is selected in such a manner that the crushing tools within said bucket travel towards said pivoting axle (4).

8 Claims, 2 Drawing Sheets

BUCKET CRUSHER

BACKGROUND OF THE INVENTION

The present invention relates to a bucket crusher to be mounted in place of the bucket of an excavator or a bucket loader and including horizontal shafts provided with crushing tools which, as the shafts are rotating, disintegrate the material to be crushed and deliver resulting crushed aggregate between the shafts to a desired location.

Crushers that are suitable for crushing heavier material, such as building site debris and tree stumps, have been constructed heretofore as independent machine units including a chassis and driving gear of their own. Such machine units, whose output can be 100–300 kW, have an expensive price, and maneuvering such equipment from one working site to another is inconvenient. In order to achieve effective crushing, such units are fitted with pairwise oppositely rotating tool shafts, whereby the material will be forced between the shafts and creating extremely high forces as a result of jamming. In addition, such units require a separate feeding mechanism or machine for carrying the material to the crushing shafts.

On the other hand, there are prior known screen crushers to be fitted in place of the bucket of an excavator and intended for comminuting and assorting earth materials and peat. Also these employ rotatable crushing shafts provided with tools.

An object of the invention is to provide a novel type of bucket crusher, which is capable of crushing material, for example, building site debris and tree stumps, but which does not suffer from the drawbacks and restrictions encountered in prior known crushers such as in terms of price and mobility as well as with respect to feeding and transferring the material from one place to another.

Another idea is to employ the existing hydraulic system and engine output of a so-called basic machine as the power source for the crusher, since the output of this feeding machine is normally used for just part of the working time.

A particular object of the invention is to provide a bucket crusher, wherein the handling of a material to be crushed is carried out effectively and evenly distributed over the area of all crushing shafts.

SUMMARY OF THE INVENTION

The foregoing and other objects and advantages can be achieved by providing a bucket crusher having horizontal shafts. The shafts have crushing tools which, rotating with the shafts, disintegrate the material and deliver the resulting crushed aggregate between the shafts. The shafts rotate in the same direction. A compression and feeding plate, pivotable about one of its edges, is pivotable by means of power units between first and second positions so as to compress the material for crushing against the crushing tools and shafts.

BRIEF DESCRIPTION OF THE DRAWINGS

One exemplary embodiment of the invention will now be described with reference made to the accompanying drawings, in which.

DETAILED DESCRIPTION OF THE PREFERRED EMBODIMENT

Figure 1:
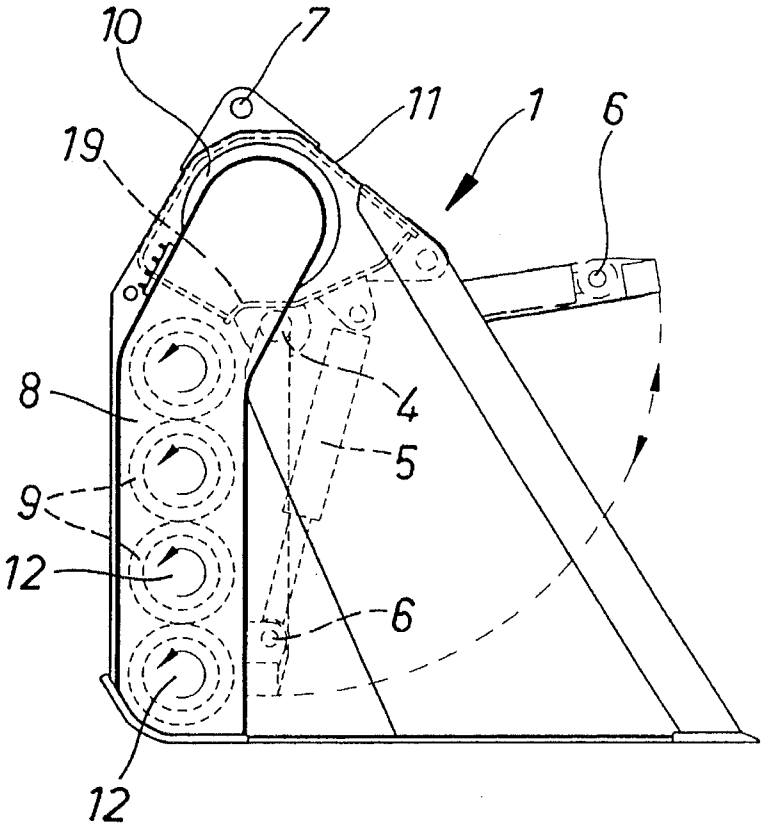
FIG. 1 is a side view of a bucket crusher of the invention.

The bucket crusher includes a compression and feeding plate 1, which is journalled to be pivotable around a pivoting axle 4 for turning it by means of power units such as a piston-cylinder unit 5 from a horizontal position shown in FIG. 1 to a vertical position shown by dash lines. Reference numeral 6 indicates a pivoting axle engaged by the piston rod end of pivoting cylinder 5.

Figure 2:
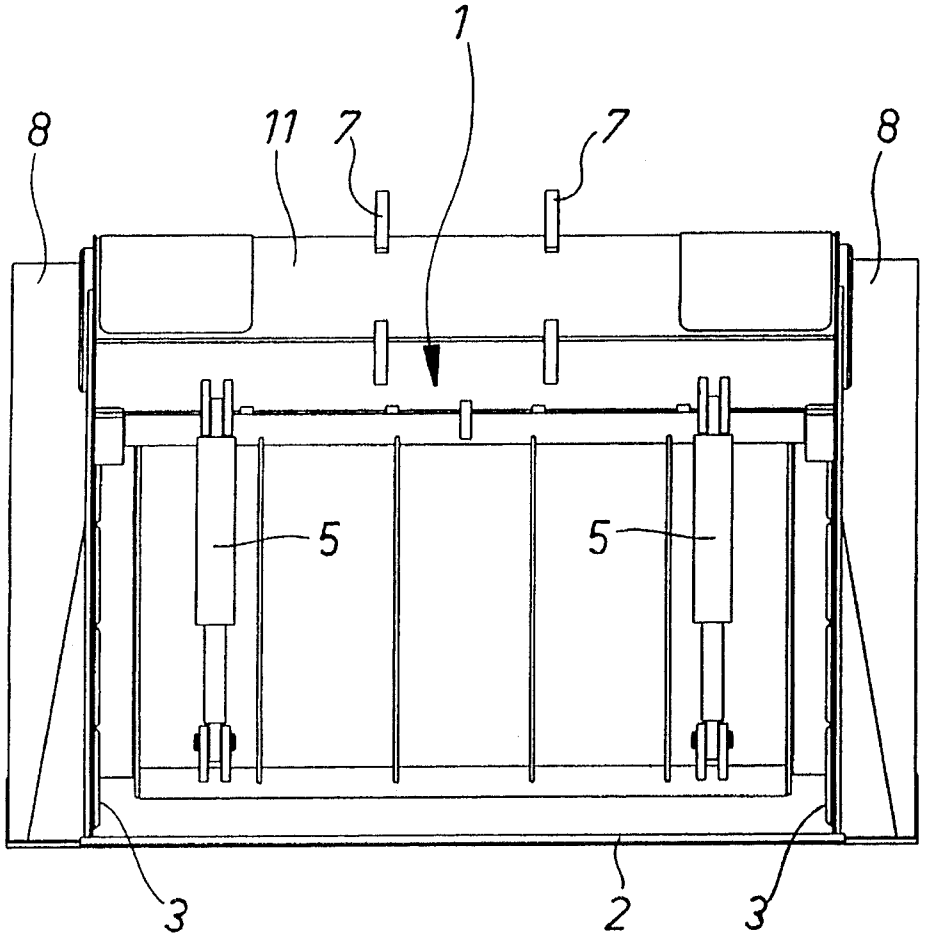
FIG. 2 is a front view of the same bucket crusher.
Figure 3:
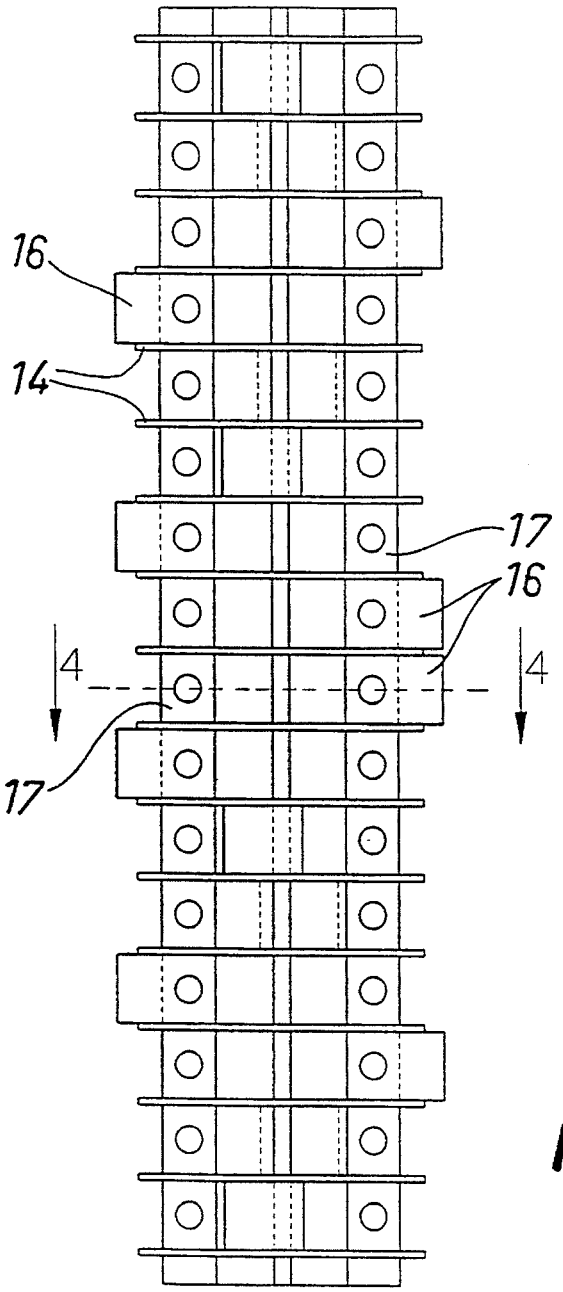
FIGS. 3 and 4 illustrate a crushing shaft provided with crushing tools as seen in the directions perpendicular and parallel to the shaft, respectively.

The main body of the bucket crusher consists of a floor plate 2 and side plates 3 provided on either side thereof with boxes 8 and between the top ends thereof with a tubular box 11 whose bottom surface has an edge 19 serving as a counter tool. Power is transmitted to crushing shafts 12, 13 by chains and sprockets 9 located in the boxes 8. Inside the horizontal box 11 connecting said boxes 8 is mounted two hydraulic motors 10, one motor on each end of the box 11 adjacent to the boxes 8. As shown in FIGS. 1 and 2, the chains and sprockets 9 are arranged for rotating the crushing shafts 12, 13 in the same rotating direction. This rotating direction is selected in such a manner that tools 16, 17 mounted on the side of the shafts 12, 13 facing said plate 1 travel upwards towards the fixed counter tool 19.

Figure 4:
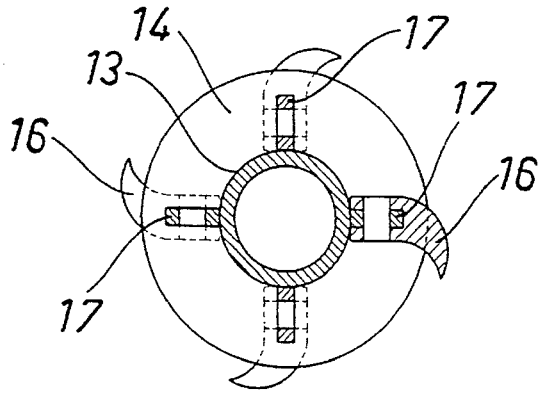

As shown in FIG. 4, the tubular shafts 13 are provided at an axial distance from each other with spacer discs 14, having therebetween tools 16 and flat bars 17 serving as said counter tools and also as holders for the tools 16. The flat bars 17 are welded to the surface of the pipe 13 and extend through the spacer discs 14 and are welded also to the latter. Between each pair of discs 14 it is possible to install one or two tools 16, depending on the type of material and desired size of the pieces. The counter tool in action is always the flat bar 17 included in the neighboring crushing drum. Upon swinging within the outer periphery of the spacer discs 14 included in the neighboring shaft, said crushing tool 16 passes the rotating counter tool 17 at a very close distance, which ensures effective crushing. The tools 16 can be mounted either in a straight line or spirally around the pipe shaft 13.

The apparatus is driven and operated as follows. With the plate 1 in the position shown in FIG. 1, the material is picked up by the bucket crusher the same way as the bucket of an excavator or a bucket loader. This is followed by turning the entire bucket crusher in such a manner that the crushing shafts 12 provide an inclined crushing table, enabling the passage of crushed material through the interstices between the shafts 12. By turning the plate 1 the material is forced against the crushing shafts 12. Upon rotation, said shafts 12, along with their tools 16, 17, lift the material upwards or in the direction opposite to the rolling caused by gravity. Thus, the material is evenly distributed over the crushing shafts and the crushed material passes between all of the shafts. The material to be crushed may also be pressed against the counter tool 19. The material reduced to a proper size is also capable of trickling down from the bucket through a gap between that counter tool and the topmost shaft 12. Finally, non-crushable material, such as rocks and pieces of metals, can be removed from the bucket crusher to a desired location. A bucket crusher of the invention is capable of picking up the material to be crushed from desired locations and carrying the crushed material to desired locations by using the boom assembly and/or-chassis of a basic machine. The clogging and overloading between the crushing shafts cannot occur as a result of jamming, since the shafts rotate in the same direction. If, for example, just one shaft is subjected to loading in the crushing situation, that particular shaft can be supplied with full power. The motors 10 are mounted and well protected in the housing ill in the top section of a bucket crusher. The crushing efficiency is increased by the selection of the rotating direction of shafts 12 and by locating the pivoting axle of plate 1 in the top section of the bucket. In the illustrated case, the topmost portion of the bucket comprises brackets 7 for pivotably mounting the bucket on the end of the boom of a working machine.

While a preferred embodiment of the invention has been described herein, it should be apparent to one skilled in the art that various changes and modifications can be made without departing from the true spirit and scope of the invention as recited in the following claims.

What is claimed is:

1. A bucket crusher to be mounted in place of the bucket of an excavator for crushing material, comprising:

substantially horizontal shafts having crushing tools which, as the shafts are rotating, disintegrate the material to be crushed and deliver resulting crushed aggregate between the shafts;

wherein said shafts as well as their crushing tools have a same rotating direction when in an operating position;

a pivoting axle provided on the bucket crusher;

a compression and feeding plate journalled to be pivotable at an edge around said pivoting axle, said plate being pivotable by means of power units between a first and a second position whereby, in the first position of said plate there is a substantially larger angle between the plate and a plane extending through the shafts than in the second position of said plate in which the plate compresses the material to be crushed against the crushing tools and the shafts; and wherein said rotating direction of the shafts and crushing tools is selected such that the crushing tools on a side of the shafts facing the plate travel towards a side of the bucket crusher which is provided with said pivoting axle.

2. A bucket crusher in accordance with claim 1, wherein the pivoting axle is located in a top section of the bucket crusher in such a manner that, as the plate is pivoting towards the shafts, a free edge of said plate approaches a floor plate of said bucket crusher.

3. A bucket crusher in accordance with claim 2, wherein when said plate is in said second position, the plate is located between the floor plate and the plane that the plate assumes in said first position.

4. A bucket crusher for crushing material, comprising:

a plurality of shafts rotatably mounted to the bucket crusher, said shafts being substantially horizontal;

crushing tools attached to said shafts for rotation therewith, said tools disintegrating the material to be crushed and delivering the crushed material through the interstices between said shafts as said shafts rotate;

a compression and feeding plate, pivotally connected to said bucket crusher at an edge of said plate, said plate being pivotable between a first and a second position, wherein in said first position there is a substantially larger angle between said plate and a plane extending through said shafts than in said second position wherein said plate is disposed to compress the material to be crushed against said crushing tools;

a power unit connected to said plate for pivoting said plate; and wherein said shafts rotate in a same direction in which said crushing tools, when on the side of said shaft facing said plate, travel towards a side of the bucket crusher to which said plate is pivotally connected to said bucket crusher.

5. A bucket crusher in accordance with claim 4 wherein said plate is pivotally connected to said bucket crusher at a top section of the bucket crusher such that as said plate pivots towards said shafts, a free edge of said plate approaches a bucket floor plate.

6. A bucket crushes as set forth in claim 5 wherein when said plate is in said second position, said plate is located between said floor plate and the plane that said plate assumes in said first position.

7. A bucket crusher as set forth in claim 4 wherein said power unit comprises a piston cylinder unit for pivoting said plate between said first and second positions.

8. A bucket crusher as set forth in claim 4 further comprising a pivoting axle pivotally connecting said plate to said bucket crusher.

* * * * *

UNITED STATES PATENT AND TRADEMARK OFFICE
CERTIFICATE OF CORRECTION

PATENT NO. : 5,485,689

DATED : Jan. 23, 1996

INVENTOR(S) : Markku Jonninen, Hollola, Finland

It is certified that error appears in the above-identified patent and that said Letters Patent is hereby corrected as shown below:

Column 3, line 7, delete "housing ill" and insert --housing 11-- therefor.

Column 4, line 36, delete "crushes" and insert --crusher-- therefor.

Signed and Sealed this

Twenty-first Day of May, 1996

*Attest:*

Bruce Lehman

BRUCE LEHMAN

*Attesting Officer*

*Commissioner of Patents and Trademarks*